US007118411B2

(12) United States Patent
Huang et al.

(10) Patent No.: US 7,118,411 B2
(45) Date of Patent: Oct. 10, 2006

(54) SYSTEM TRANSFORMATION CONNECTOR

(75) Inventors: Hung Way Huang, Taipei (TW); Swu Lin Dwan, Xinchin (CN); Wei Wan, Xinchin (CN)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 10/906,502

(22) Filed: Feb. 23, 2005

(65) Prior Publication Data

US 2006/0189206 A1 Aug. 24, 2006

(30) Foreign Application Priority Data

Nov. 19, 2004 (TW) ..... 93218617 U

(51) Int. Cl.
*H01R 11/00* (2006.01)

(52) U.S. Cl. ..... 439/502

(58) Field of Classification Search ..... 439/502, 439/638, 289, 362, 65, 701, 594, 557, 607–610
See application file for complete search history.

(56) References Cited

U.S. PATENT DOCUMENTS 5,709,568 A * 1/1998 Pan et al. ..... 439/541.5
6,039,611 A * 3/2000 Yang ..... 439/701
6,447,339 B1 * 9/2002 Reed et al. ..... 439/638
6,527,564 B1 * 3/2003 Yeh ..... 439/76.1
6,709,286 B1 * 3/2004 Korsunsky et al. ..... 439/557
6,716,057 B1 * 4/2004 Wu ..... 439/497
6,722,897 B1 * 4/2004 Wu ..... 439/76.1
6,935,896 B1 * 8/2005 Tsai ..... 439/607
6,948,980 B1 * 9/2005 Xiang et al. ..... 439/607

* cited by examiner

*Primary Examiner*—J. F. Duverne

(57) ABSTRACT

The present invention provides a system transformation connector, which comprises two male/female connectors of different transmission interfaces, a fixing partition plate attached to the female connector, two circuit boards connected to the two male/female connectors of different interfaces and a plastic shell covering around the electrical transformation connector; therein, one of the two circuit boards is connected to the two male/female connectors of different interfaces, the other circuit board is connected to the female connector only and develops a closed circuit together with the previous circuit board through terminals to achieve signal transmission in the circuit of electronic products.

3 Claims, 2 Drawing Sheets

SYSTEM TRANSFORMATION CONNECTOR

BACKGROUND OF THE INVENTION

1. Field of the Invention

The present invention relates to a system transformation connector, especially, to a system transformation connector used for connecting two different transmission interfaces.

2. Prior Arts

As the time goes on, electronic product updates ceaselessly, but with regard to an enterprise, which increases a company's costs with renewing electronic device constantly, and the old electronic device can't meet requirements only in a certain domain, but it still could achieve the same effect as a new electronic device via a transformation connector, so there is no need to cause unnecessary waste for this renewal, which brings about a new commercial opportunity to the connector manufacturers.

In the transformation connector used nowadays, a great majority of the transformation connectors are linked by cables. It is hard and inconvenient to solder by hand and it must use additional sleeve tubes for insulation to avoid short circuit among the connecting wires when the cable is soldered to the transformation connector for connection because of too many terminals, so the production efficiency is low can't reach the predetermined request; this kind of transformation connector still has a principal defect it would lose a portion of signal in data transmission for connected by soldering cable, so the user couldn't get the optimum use effect for poor signal transmission quality, and the structure design of this kind is relatively large and heavy. Due to the substantial problems in the conventional transformation connector, the conventional transformation connector ought to be improved.

SUMMARY OF THE INVENTION

The main object of the present invention is to provide a system transformation connector, especially, relates to a transformation connector used for connecting two different transmission interfaces which could resist high frequency interference and ensure the signal and data against losing.

Another object of the invention is to provide a system transformation connector, which is simple in structure and is convenient in assembly and could improve productivity.

To achieve the above objects, the present invention could be realized through following technique schemes. The system transformation connector comprises two male/female connectors of different transmission interfaces, a fixing partition plate attached to the female connector, two circuit boards in different sizes connected to the two male/female connectors of different interfaces and a plastic shell covering around the electrical transformation connector; therein, the male/female connectors are assembled in standard, the fixing partition plate has parallel through holes for the terminal legs of the female connector passing through, the two circuit boards are placed on the rear part of the fixing partition plate, therein, the small circuit board is placed between the uppermost and the middle rows of terminals of the female connector, but the large circuit board is placed between the lowermost and the middle rows of terminals of the female connector, and the other side of the large circuit board is connected to another male connector, but the small circuit board is connected to the female connector only by one side, but because the obverse and reverse sides of the circuit board have circuits connected with terminal legs, through a special device the terminals could be connected with each circuit board, the middle row of terminals of the female connector are connected with the two large/small circuit boards respectively, so the two circuit boards develop a closed circuit to achieve electrical signal transmission, the plastic shell is formed by injection over-molding around the foregoing half-finished electrical transformation connector.

From the above description known, the advantages of the invention wherein the system transformation connector connects two connectors of different transmission interfaces through two circuit boards of different sizes and provides a structure having a terminal location effect, it is easy in assembly and is compact in volume, resists high frequency interference to ensure the signal and data against losing and improve signal transmission quality in transmission.

In order for those skilled in the art to comprehend fully the structure features of the invention, as well as other objects and functions of the invention, presently an embodiment is given, a detailed description is given thereafter with attached figures, the chosen embodiment is only illustrative to the present invention, the invention still has other embodiments, any other modifications or changes made by those skilled in the art via the specification without departing from the spirit of the invention are covered in the claims of the present invention.

BREIF DESCRIPTION OF THE DRAWINGS

DETAILED DESCRIPTION OF THE INVENTION

Figure 1:
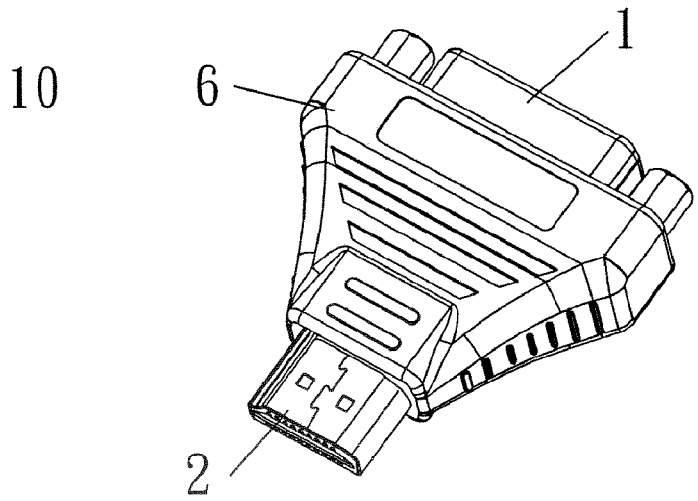
FIG. 1 is a perspective view of the embodiment in the present invention.
Figure 2:
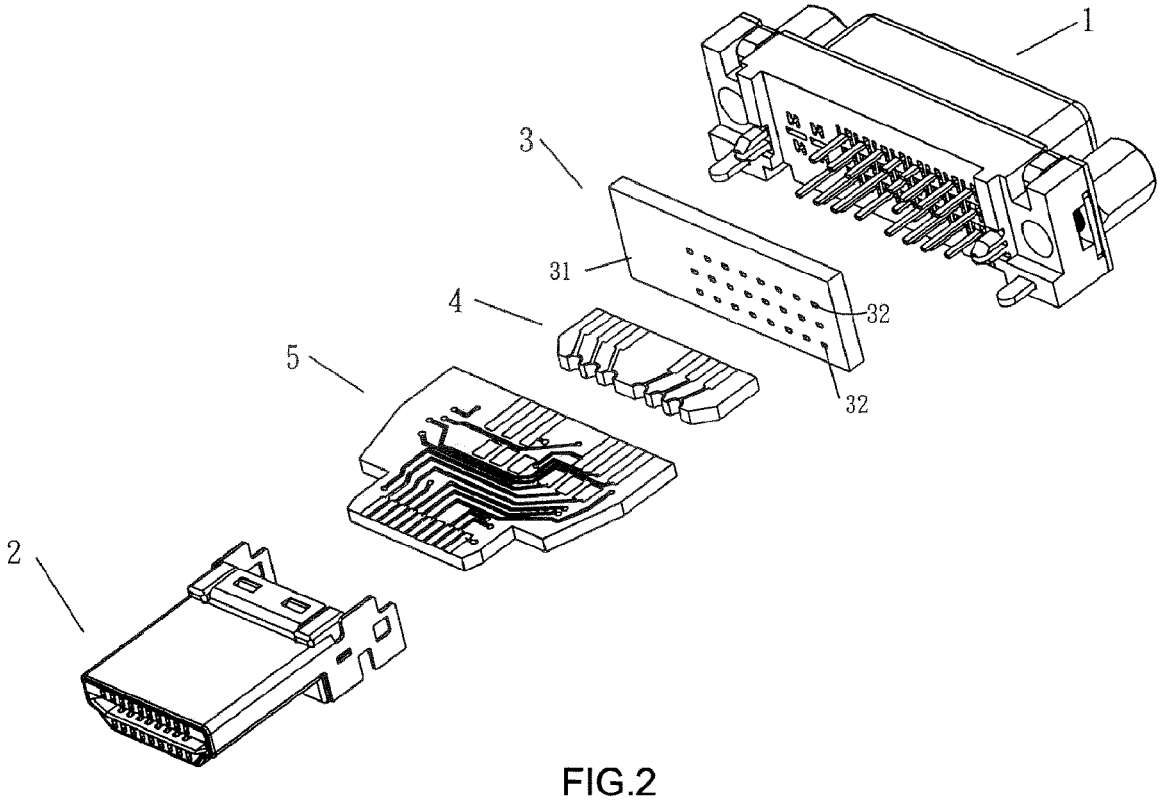
FIG. 2 is an exposed perspective view of the embodiment in the present invention.

Referring to FIGS. 1 and 2, as regard to the given preferred embodiment of the invention, the system transformation connector 10 is combined by a DVI connector and an HDMI connector, the transformation connector 10 comprises a female connector 1, a male connector 2, a fixing partition plate 3 attached to the female connector 1, a circuit board 4, a circuit board 5 connected to the two different transmission interface connectors and a plastic shell 6 covering around the electrical transformation connector.

As shown in FIG. 2, the female connector 1 and the male connector 2 are two types of connectors of different transmission interfaces, each component of the connectors is a standard existing part, which is described in the earlier patent applications, so no description is given to a particular connector component again.

The fixing partition plate 3 assembled on rear part of the female connector 1 is in a rectangular structure which includes a body portion 31, on the body portion 31 having a plurality of through holes 32 paralleled to each other which adapts for the terminal legs of the female connector 1 to pass through, in the present embodiment, the terminals of the female connector 1 are arranged in three rows, therefore the through holes 32 are also arranged in three rows.

After the terminals of the female connector 1 are fixed via the fixing partition plate 3, the two circuit boards 4 and 5 of different sizes are assembled on the rear of the fixing partition plate 3, the circuit boards 4 and 5 are arranged on the upper and lower positions, the circuit board 4 is assembled between the uppermost and the middle rows of terminals of the female connector 1, but the circuit board 5 is assembled between the lowermost and the middle rows of terminals of the female connector 1, and the other side of the circuit board 5 is connected to the male connector 2, therefore the terminals on the female connector 1 and the male connector 2 are connected electrically via the circuits arranged on the obverse and reverse sides of the circuit boards 4 and 5.

Figure 3:
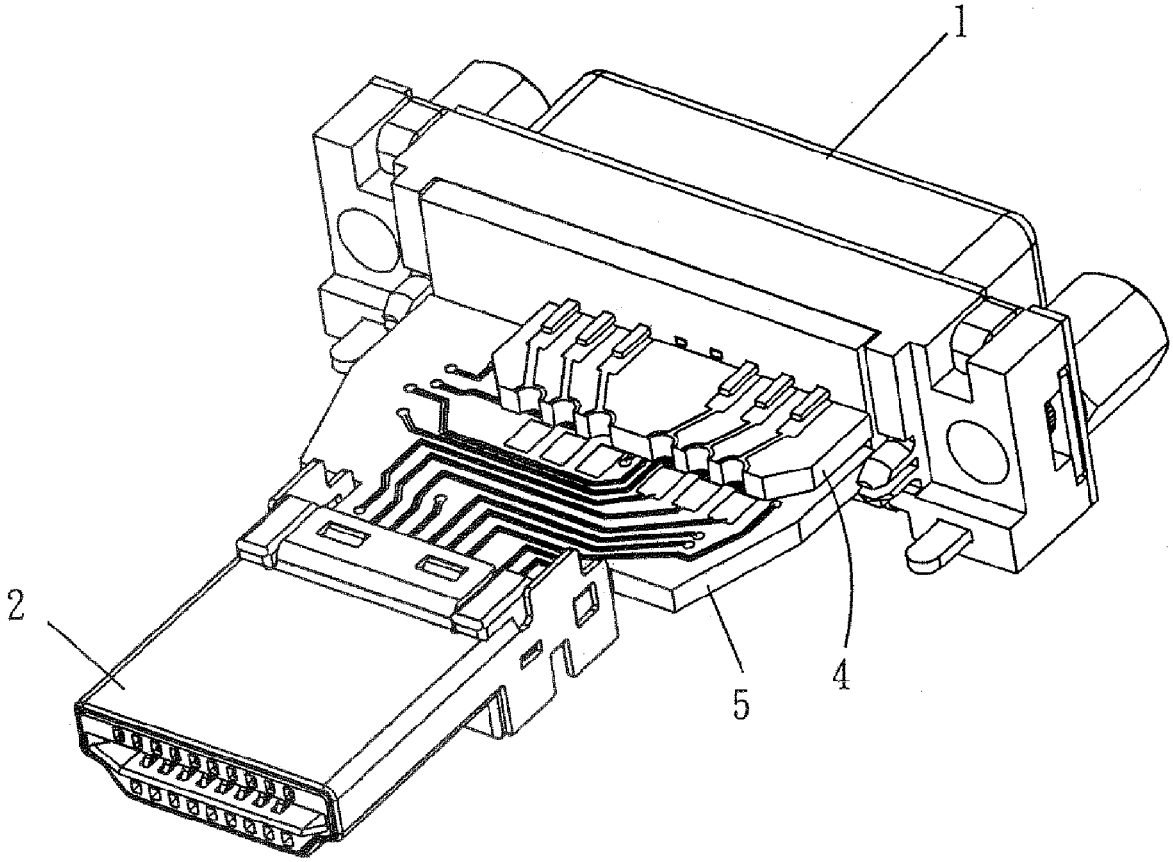
FIG. 3 is an assembled view of the embodiment in the present invention.

In the present invention the structure of the transformation connector is obvious, and as to the assembly procedures thereof, which could not be easier, the female connector 1 and the male connector 2 are assembled in standard beforehand, the terminals of the female connector 1 are passed through the through holes 32 on the fixing partition plate 3, and the fixing partition plate 3 is attached on rear of the female connector 1, circuit board 4 is sandwiched between the uppermost and the middle rows of terminals of the female connector 1 and soldered firmly with two rows of terminals, and circuit board 5 is sandwiched between the lowermost and the middle rows of terminals of the female connector 1 and soldered firmly with two rows of terminals also, and the other side of the circuit board 5 is connected to and soldered firmly with the terminals of the male connector 2, there are circuits on the obverse and reverse sides of the circuit boards 4 and 5 for soldering with the terminal, therefore the middle row of terminals are both soldered with circuit board 4 and with the circuit board 5, now the circuit boards 4 and 5 develop a closed circuit (as shown in FIG. 3) to achieve signal transmission in the circuit, and plastic shell 6 is formed by injection over-molding after the foregoing half-finished product is put into a predetermined mold, the completely finished electrical transformation connector is shown as FIG. 1.

In combination with the description above-mentioned, the present invention uses two circuit boards in different sizes to connect two different transmission interface connectors, which avoids using a cable for connection to bring about low productivity, solves the difficulties in operation, at the same time resists high frequency from interference and ensures signal and data from losing.

What is claimed is:

1. A system transformation connector comprising a plural printed circuit boards, a fixing partition plate having an uppermost, a middle and a lowermost terminals, a plastic shell, a female connector and a male connector wherein terminals of the female connector are passed through through holes on the fixing partition plate, and the fixing partition plate is attached on rear of the female connector, a first circuit board is sandwiched between the uppermost and the middle rows of terminals of the female connector and soldered firmly with the two rows of terminals, and a second circuit board is sandwiched between the lowermost and the middle rows of terminals of the female connector and soldered firmly with two rows of terminals, wherein the other side of the second circuit board is connected to and soldered firmly with the terminals of the male connector.

2. A system transformation connector as claimed in claim 1, wherein the middle row of terminals are both soldered with the first circuit board and the second circuit board to enable the first circuit board and the second circuit board forming a closed circuit to achieve signal transmission in the circuit.

3. A system transformation connector as claimed in claim 1, wherein the plastic shell is formed by injection over-molding.

* * * * *